United States Patent [19]

Chaffee

[11] Patent Number: 4,977,633

[45] Date of Patent: Dec. 18, 1990

[54] COLLAPSIBLE AIR BED

[76] Inventor: Robert B. Chaffee, 78 Montgomery St., Boston, Mass. 02116

[21] Appl. No.: 384,786

[22] Filed: Jul. 25, 1989

[51] Int. Cl.[5] ..... A47C 27/08

[52] U.S. Cl. ..... 5/453; 5/449; 5/420

[58] Field of Search ..... 5/420, 449, 453, 454, 5/470

[56] References Cited

U.S. PATENT DOCUMENTS

| | | | |
|---|---|---|---|
| 918,391 | 4/1909 | Taarud | 5/454 X |
| 1,994,466 | 1/1934 | Rubin | 5/454 |
| 2,573,375 | 10/1951 | Winstead | 5/454 |
| 3,042,941 | 7/1962 | Marcus | 5/453 X |
| 3,877,092 | 4/1975 | Gaiser | 5/453 X |
| 4,521,166 | 6/1985 | Phillips | 5/494 X |

*Primary Examiner*—Michael F. Trettel
*Attorney, Agent, or Firm*—Wolf, Greenfield & Sacks

[57] ABSTRACT

A collapsible, portable, stowable, air inflatable bed is disclosed. The bed consists of an air mattress supported at the head from a hollow cylinder. One end of the hollow cylinder forms the support housing and the air conduit for an electric motor driven air pump. The other end of the hollow cylinder provides miscellaneous storage space. The surface of the cylinder provides a roller assembly onto which the air bed is rolled as it is being deflated. The mattress is inflated and automatically unrolled by pumping air through a one-way valve into the interior of the mattress. When the user is lying on the mattress, the firmness can be increased by energizing the pump motor, or the firmness can be decreased by manually releasing air through the one-way valve. The mattress is rapidly deflated by first opening a relatively large valve at the end of the mattress opposite the cylinder, and then hand rolling the mattress on to the cylinder. A unique beeding system is also disclosed.

21 Claims, 3 Drawing Sheets

COLLAPSIBLE AIR BED

This invention relates to a collapsible, portable, stowable, air inflatable bed intended to provide extra sleeping accomodations for small homes or apartments, mobile homes or motor coaches, and in other environments where space is at a premium, and comfort is a requirement. The bed consists of an air mattress supported at the head from a hollow cylinder. One end of the hollow cylinder forms the support housing and the air conduit for an electric motor driven air pump. The other end of the hollow cylinder provides miscellaneous storage space. The surface of the cylinder provides a roller assembly onto which the air bed is rolled as it is being deflated. The mattress is inflated and automatically unrolled by pumping air through a one-way valve into the interior of the mattress. When the user is lying on the mattress, the firmness can be increased by energizing the pump motor, or the firmness can be decreased by manually releasing air through the one-way valve.

The mattress is rapidly deflated by first opening a relatively large valve at the end of the mattress opposite the cylinder, and then hand rolling the mattress on to the cylinder. A unique bedding system is also disclosed.

THE PRIOR ART

Many air mattresses are known in the prior art, however, none of the prior art mattresses disclose the combination of features which provide the comfort, portability and stowability of the air bed disclosed herein. The most simple and well known air mattress is the type used for camping and generally it includes an inlet valve through which air may be pumped or blown in by mouth. The same valve is used for exhausting the air when it is desired to deflate the mattress for storage.

U.S. Pat. No. 918,391 issued to Taarud in 1909 is a variation of the simple air mattress in that it provides a manually operated piston pump to which a collapsible air pillow is attached. The pump cylinder provides a form on which the pillow is rolled for storage.

The Swenson et al. U.S. Pat. No. 4,394,784 shows a mattress in which the air pressure within a mattress is varied by pumping air to the interior of the mattress bladder by means of a motor driven air pump through a solenoid actuated valve, and wherein air is exhausted by energizing the solenoid, but not the motor. Swenson et al. does not show a collapsible mattress. Neither Taarud or Swenson, alone or in combination, functions to provide the various combination of the features of the invention herein disclosed and claimed. The disclosed arrangement, unlike Swenson, provides a portable mattress which can be unrolled, and which can rapidly and easily be rolled up and stored. Moreover, unlike Taarud, the disclosed invention can be automatically unrolled, and the internal pressure of the mattress is adjustable.

SUMMARY OF THE INVENTION

In accordance with this invention, I provide a rigid roller assembly comprised of three cylinder modules which serve: (1) as as the housing and the support for a motor driven rotary air pump; (2) as the air inlet and outlet to and from the interior of the mattress; (3) as a mandrel on to which the mattress is rolled for storage and to provides rapid deflation through a second outlet valve; and (4) as convenient storage space.

The invention provides for the automatic unrolling of the mattrees as it inflates, and also includes a bedding system not shown in the prior art.

In summary, this invention provides an inflatable air bed which employs a rectangular air inflatable bladder in the shape of a bed mattress having a head, a foot and a sleeping surface. The head of the bladder is secured to the roller assembly, and is wound onto the roller assembly for storage. The roller assembly comprises three detachably interconnected cylindrical modules, including a pump support module at one end, an intermediate valve support module adjacent said pump support module, and a storage module at the other end. A motor diven pump is mounted in the pump support module and a one-way pressure actuated valve is mounted in the valve support module. The flow path from said valve and pump support modules to the storage module is closed, and an airtight fluid conduit including the valve is provided from the bladder into the valve and pump support chambers. The output from said air pump flows into the interior of the bladder through said pressure actuated one-way valve. Means are provided in the valve support module for manually opening said valve. Thus when the air pump supplies pressurized air to the bladder through the one-way valve, the bed unrolls and is inflated. The comfort level of the bed can be adjusted by releasing air from the bladder by the manipulation of the valve when the pump is not operating.

DESCRIPTION OF A PREFERRED EMBODIMENT

Figure 1:
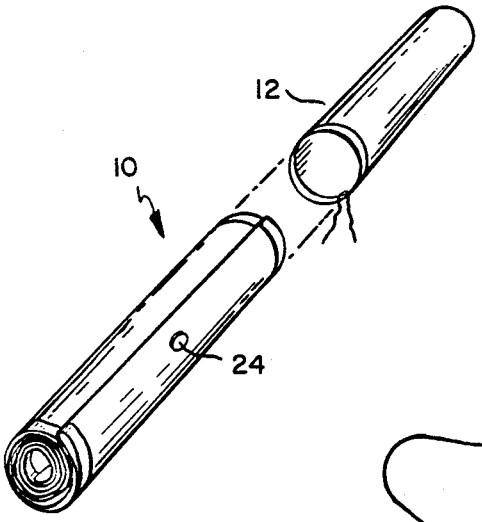
FIG. 1 is a three-dimensional view showing a collapsed mattress in its rolled up state, ready to be inserted into its storage bag.

FIG. 1 shows an air bed 10 in its collapsed, deflated condition ready to be inserted into storage bag 12.

Figure 2:
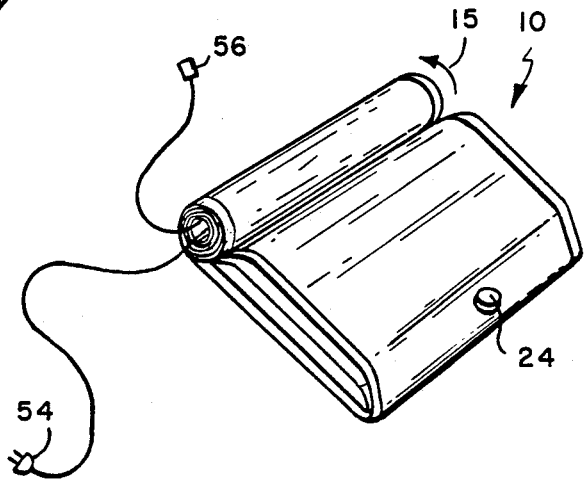
FIG. 2 is a three-dimensional view showing the mattress unrolling during inflation.

FIG. 2 shows the mattres 10 in a partially unrolled and partially inflated state. As will be pointed out hereinafter, the mattress automatically unrolls as it is inflated.

Figure 3:
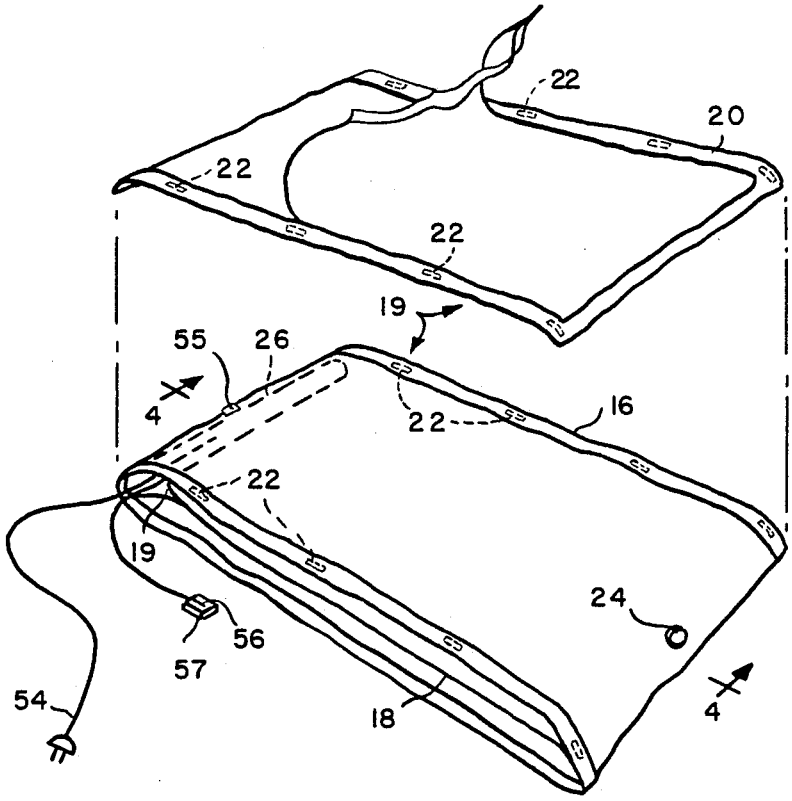
FIG. 3 is a three-dimensional view showing the the mattress in its fully unrolled state, and also showing the bedding system.
Figure 4:
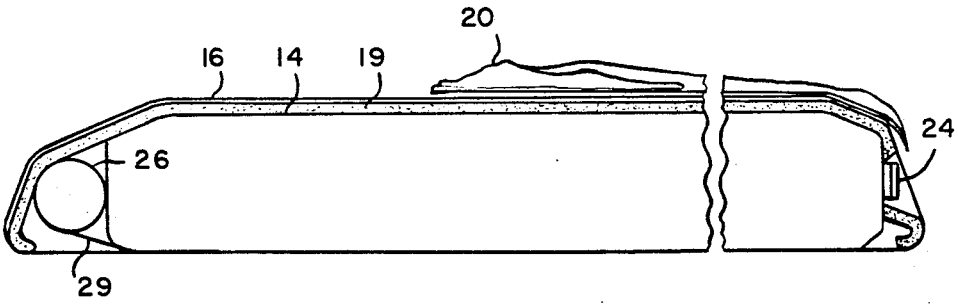
FIG. 4 is a cross-sectional view of the inflated mattress taken through the line 4—4 in FIG. 3.

FIGS. 3 and 4 show a fully inflated mattress 10 including a preferred embodiment of the bedding system. The mattress includes an air impermeable mattress shaped bladder 14 (see FIG. 4) which is contained within a mattress cover or sack 16. A zipper 18 (see FIG. 3) closes the cover, but provides an opening to the chambers within roller assembly 26, hereinafter described. While the manner in which the mattress 10 is constructed forms no part of this invention, it basically is a closed mattress shaped sack formed of sheets of impervious plastic or rubber materials which are bonded together or otherwise sealed to provide an air tight enclosure.

As seen in FIG. 4, conventional padding 19 is positioned between the bladder 14 and the cover 16 to pad and insulate the sleeping surface of the bladder 12. Sheeting in the form of a rectangular sack 20 is secured to the mattress cover 16 by means of a plurality of pairs of Velcro style hook and loop pads 22 distributed on the opposing faces of the priphery of the sack and the cover.

A large manually operated exhaust valve 24 located in the bladder 12 extends through appropriate apertures in the cover and pad at the foot of the bed.

Figure 6:
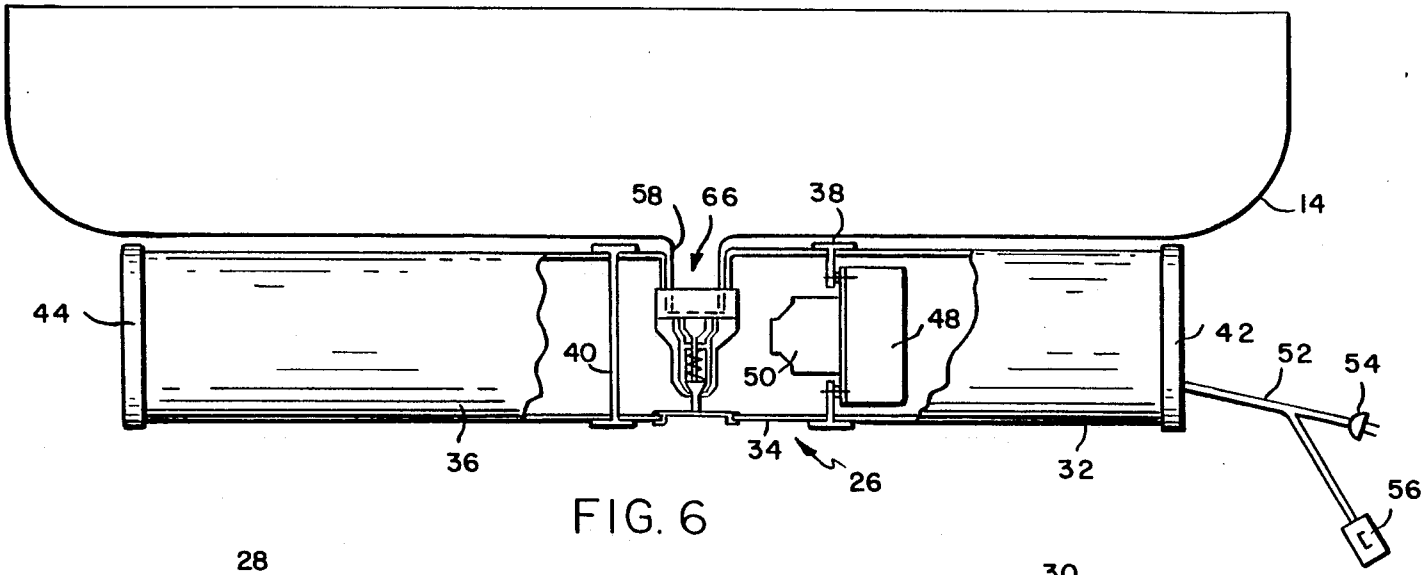
FIG. 6 is a plan view with a portion of the cylinder broken away.
Figure 5:
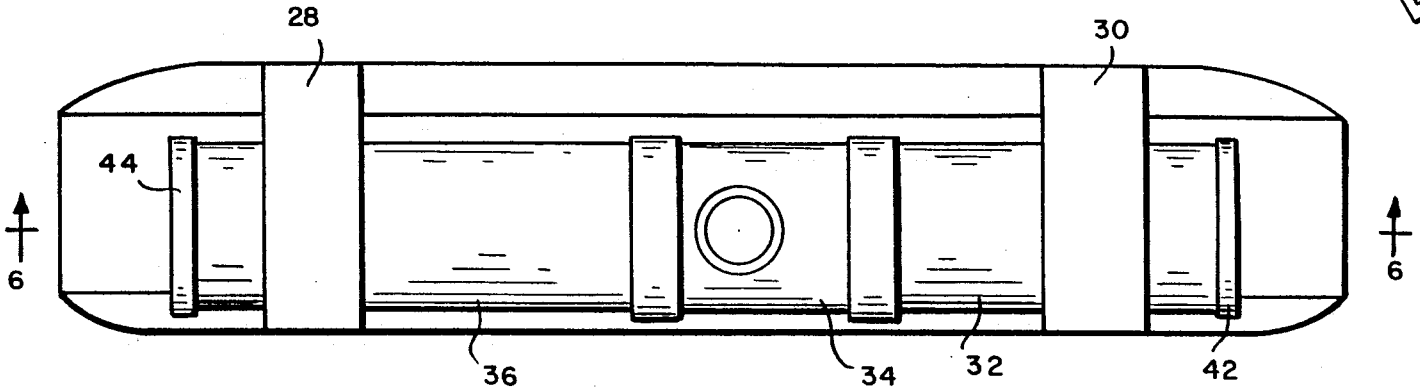
FIG. 5 is an end view of the mattress with the bedding removed.

As shown in FIGS. 4, 5 and 6, the roller assembly 26, comprised of hollow cylindrical modules, is secured to the head end of the bladder by means of a pair of spaced straps 28 and 30. As will be hereinafter explained, the cylindrical housing of the roller assembly 26 serves (1) as a mandrel on which the air bed 10 is wound, (2) as a support and air conduit for the pump used to inflate the mattress 14, (3) as a support for the manual valve operator used to exhaust air to reduce the pressure within the bladder, and (4) for storage of bedding and miscellaneous items.

As best seen in FIGS. 5 and 6, the cylindrical housing of the roller assembly 26 is comprised of three cylindrical modules, the air supply module 32, the pressure control module 34 and the storage module 36. The three modules are threaded together at flanged discs 38 and 40. Structural rings 42 and 44 reinforce the ends of the modules 32 and 36, respectively. A flanged disc 40 closes and seals the inner end of cylinder storage module 36, while the flanged disc 38 has a central opening through which air can freely flow.

The cylinder 26, the discs 38 and 40, and the rings 42 and 44 are constructed of a rigid plastic capable of supporting the various elements which are mounted therein. The flanged disc 38 supports an air pump or fan 48 and a pump driving A.C. motor 50. The motor 50 is connected by means of wiring 52 and a conventional plug 54 to a source of 60 cycle house power, not shown, and its operation is controlled by means of a conventional on/off switch 56. As shown, switch 56 and the wiring 52 to the electric motor 50 extend through the module 32, and are stored therein when not in use. When so removed the switch 56 is can be held by a person lying on an inflated bed 10, or it may be mounted on the cover at the head of the bed by means of Velcro style hook and loop pads 55 and 57.

When the electric motor 50 is energized, air is driven from the air supply module 32 into the pressure control module 34 which provides the air conduit to the interior of the bladder 14, and which supports a pressure control valve 66 which is selectively actuated either manually or by air pressure.

The bladder 14 has a cylindrical neck 58 which extends into an inwardly projecting cylyndrical neck 60 in the center module 34. The neck 60 has threads 62 onto which the housing 64 of the control valve 66 is threaded, with the bladder neck 58 clamped therebetween.

Figure 7:
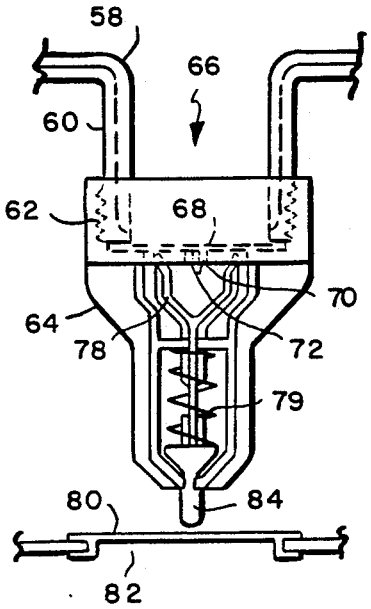
FIGS. 7 and 8 show the pressure control valve used in accordance with this invention.

The control valve 66 (see FIGS. 7 and 8) comprises a rubber membrane or diaphram 68 which is attached to the center of a support spider 70 by means of pin 72. Air pressure within the bladder 14 maintains the membrane 68 in a flat condition on the spider 70 and closes the opening to the bladder 58, and thus maintains the air pressure within the bladder. A plunger 74 having a stem 76 and tines 78 is normally biased by means of spring 79 into the position shown in FIG. 7. A rubber diaphram mounted in a aperture 82 in the wall of module 34 is positioned adjacent the plunger tip 84.

Figure 8:
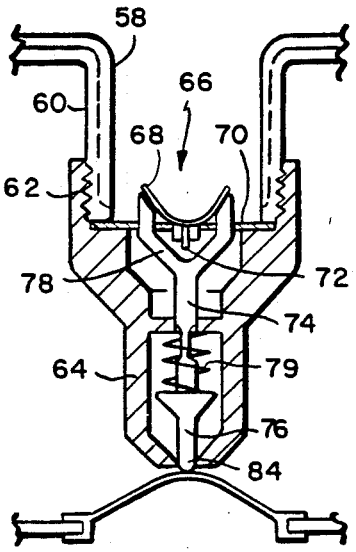

The diaphram 68 is deflected to unseal the neck 58 of bladder 14 in one of two ways. First, turning on the motor 50 to operate the fan 48 increases the pressure in module 34 to cause the deflection of the membrane 68 to admit air to the bladder 14 to increase the firmness of the mattress. Any small increase in pressure is sufficienct to deflect the membrane. Second, the motor 50 deenergized, the membrane 68 can be manually unsealed by depressing the diaphram 80 to push in the plunger 74 and thereby drive the tines 78 through the spider 70 to deflect the membrance 68, as shown in FIG. 8, thereby permitting the escape of air from the bladder, and hence, reduce the firmness of the mattress.

In the use of the system, the bed 10 is first removed from its storage bag 10 and the plug 54 and switch 56 are removed from the module 32. After plugging into a conventional home outlet, and pressing the swith to its on position, the motor 50 is energized to drive the fan 48 so as to pump ambient air past the deflected rubber diaphram 68 of the valve 66. The air that is pumped into the bladder 14 forces the rolled up bed automatically to unwind in the direction of the arrow 15 (FIG. 2).

When the bed is fully unwound as depicted in FIG. 3, the user is able to adjust the personal comfort level of the bed by further increasing the pressure of the air in the bladder if the bed is too soft, or to decrease the pressure by pushing the diaphram 80 to depress the plunger 74 to mechincally deflect the diaphram 68, and permit the escape of air within the mattress until the firmness of the mattress meets the personal taste of the user.

When the bed is to be stored, the exhaust valve 24 at the foot of the bed is manually opened, and the bed, with all the bedding in place, is wound on the roller assembly cylinder 26, compressing the air in the bladder and quickly forcing the air out of the exhaust valve.

The bedding system is also unique in that it includes the insulation padding 20 held in place by the zippered cover 16, which is made of a heavy, soft fabric that provides warmth and comfort to the user. In addition the sheet 22 is held in place by appropriately located Velcro TM style hook and loop, so that the bed is not only comfortable, but is convenient for use, and the sheet is quickly and easily changed as required.

While the foregoing specification describes a preferred embodiment of this invention, it will be understood that various modifactions and adaptations will be available to persons skilled in the art. It is intended therefore that this invention be limited only by the following claims as interpretted in the light of the prior art.

I claim:

1. An inflatable air bed, the combination comprising:

a rectangular air inflatable bladder in the shape of a bed mattress having a head, a foot and a sleeping surface;

a roller assembly, the head of said bladder being secured to said roller assembly, and being wound onto said roller for storage, said roller assembly comprising a rigid hollow cylinder open at one end, and closed intermediate its ends to provide first and second chambers;

an airtight fluid conduit from said bladder into said said first chamber, said conduit including a one-way pressure actuated valve for admitting air to said bladder;

a motor driven air pump supported within said first chamber, the output from said air pump flowing into the interior of said bladder through said pressure actuated one-way valve; and means mounted in said first chamber for manually opening said valve, whereby said air pump supplies pressurized air to said bladder through said one-way valve to unroll said bladder from said roller assembly, and whereby air can be released from said bladder by the manual operation of said valve when said pump is not operating.

2. The invention as defined in claim 1, and a large manually operated pressure release valve at the foot of said bladder for the rapid deflation of said bladder.

3. The invention as defined in claim 1 wherein said second chamber is a storage chamber.

4. The invention as defined in claim 1 wherein said roller assembly comprises first, second and third axially aligned, detachably interconnected cylinders, said pump and motor being supported within said first cylinder, said valve being supported within said second cylinder, and air flow path from said pump to said third cylinder, said path being closed, whereby air flowing from said pump is directed through said valve to pressurize said bladder, and whereby said third cylinder provides a storage chamber within said roller assembly.

5. The invention as defined in claim 4, wherein said means mounted in said first chamber for manually opening said valve, is a plunger supported in said second cylinder for mechanically opening said one-way valve, and said plunger being accessable through an air tight flexible diaphram in the wall of said second cylinder.

6. The invention as defined in claim 1 wherein said roller assembly is comprised of three cylindrical modules, including a pump support module at one end, an intermediate valve support module adjacent said pump support module, and a storage module at the other end, a flow path from said valve and pump support modules to said storage module, said path being closed, said modules being detachably interconnected.

7. The invention as defined in claim 6, and an insulating pad on the sleeping surface of said bladder, and wherein the bladder, the pad and the attached roller assembly are enclosed in a fitted cover, an end of said cover being open to enable access to said modules.

8. The invention as defined in claim 7, and a sheet detachably secured to the sleeping surface of said cover.

9. In an inflatable air bed, the combination comprising:

an air inflatable bladder in the shape of a bed mattress having a head and a foot;

a rigid hollow support cylinder secured to an end wall of said bladder at said head, said cylinder being closed intermediate its ends by an intermediate wall, and being open at both ends;

first and second diametrically opposed holes in the surface of said cylinder on one side of said intermediate wall;

an airtight fluid conduit from said bladder into said cylinder through said first hole, said conduit including a pressure activated one-way valve in said conduit, said one way valve permitting the flow of pressurized air into said bladder but preventing the flow of air from said bladder, said valve including manual means for opening said valve to permit air flow from said bladder;

a flexible diaphragm sealing said second hole, said manual means being mechanically operable when said diaphram is depressed;

a motor driven air pump supported within said one side of said cylinder, the output from said air pump being connected to said the interior of said bladder through said one-way valve, whereby operation of said air pump supplies pressurized air to said bladder through said one-way valve, and whereby air can be released from said bladder by the manual operation of said valve when said pump is not operating.

10. The invention as defined in claim 9, and a large manually opened valve at the foot of said bladder for quickly releasing air from said bladder as said bladder is rolled onto said cylinder.

11. An inflatable air bed, the combination comprising:

a rectangular air inflatable bladder in the shape of a bed mattress having a head, a foot and a sleeping surface;

a roller assembly, the head of said bladder being secured to said roller assembly, and being wound onto said roller for storage said roller assembly comprising a rigid hollow cylinder;

an airtight fluid conduit from said bladder into said hollow cylinder, said conduit including a one-way pressure actuated valve for admitting air to said bladder;

a motor drive air pump supported within said hollow cylinder, the output from said air pump flowing into the interior of said bladder through said pressure actuated one-way valve; and means mounted in the hollow cylinder for manually opening said valve, whereby said air pump supplies pressurized air to said bladder through said one-way valve to unroll said bladder from said roller assembly, and whereby air can be released from said bladder by the manual operation of said valve when said pump is not operating.

12. An inflatable bed comprising:

an inflatable bladder having first and second sides;

a roller assembly attached to one of said first and second sides, said bladder being wound on said roller assembly for storage;

means including a one way valve connected to said bladder through which gas is infused to inflate said bladder; and a motor driven pump connected to said means for inflating said bladder through said valve and unrolling said bladder from said roller assembly.

13. An inflatable bed as recited in claim 12, further comprising a means for manually opening said valve to release gas from said bladder when said pump is not operating.

14. An inflatable bed as recited in claim 12, wherein an occupant of said bed can reduce the gas pressure in said bladder by manually activating said valve while reclining on said bed.

15. An inflatable bed as recited in claim 12, wherein said pump is mounted in said roller assembly.

16. An inflatable bed as recited in claim 12, wherein said roller assembly extends the entire length of said one of said first and second sides.

17. An inflatable bed as recited in claim 12, further comprising a large manually operated pressure release valve at the other of said first and second sides to rapidly deflate said bladder.

18. An inflatable bed as recited in claim 12, further comprising an insulating pad disposed on said bladder, and a fitted cover and enclosing said bladder, pad and roller assembly, said cover having an opening for access to said roller assembly.

19. An inflatable bed as recited in claim 12, wherein said roller assembly is a rigid hollow support cylinder.

20. An inflatable bed as recited in claim 12, wherein said one way valve is manually operable to release gas from said bladder after inflation by said pump, when said pump is no longer operating.

21. In combination, a motor driven pump and inflatable bed;

an inflatable bladder comprising a mattress for the bed and having first and second sides;

a roller assembly attached to one of said first and second sides, said bladder being wound on said roller assembly for storage; and a one way valve to which said pump is attached for inflating said bladder, said bladder unrolling from said roller assembly upon inflation by said motor driven pump.

* * * * *